US005784666A

United States Patent [19]

Nagase et al.

[11] Patent Number: 5,784,666

[45] Date of Patent: Jul. 21, 1998

[54] COLOR IMAGE FORMING APPARATUS

[75] Inventors: Hisayoshi Nagase; Shuta Hamada; Hiroyuki Tokimatsu; Satoshi Haneda, all of Hachioji; Toshihide Miura, Koganei, all of Japan

[73] Assignee: Konica Corporation, Tokyo, Japan

[21] Appl. No.: 580,603

[22] Filed: Dec. 29, 1995

[30] Foreign Application Priority Data

Jan. 6, 1995 [JP] Japan ..... 7-000658
Oct. 18, 1995 [JP] Japan ..... 7-270194

[51] Int. Cl.[6] ..... G03L 15/00

[52] U.S. Cl. ..... 399/44; 347/232

[58] Field of Search ..... 355/30; 399/44, 399/94, 96; 347/130, 133, 232, 233, 238

[56] References Cited

U.S. PATENT DOCUMENTS 4,647,181 3/1987 Kohyama et al. ..... 399/232
5,191,353 3/1993 Corona ..... 347/232

FOREIGN PATENT DOCUMENTS 62-66958 3/1987 Japan .
62-71682 4/1987 Japan .
2-233267 9/1990 Japan .
5-307307 11/1993 Japan .

*Primary Examiner*—Joan H. Pendegrass
*Attorney, Agent, or Firm*—Frishauf, Holtz, Goodman, Langer & Chick

[57] ABSTRACT

In a color image forming apparatus, wherein plural toner images are superimposed on the photoreceptor during a single rotation of the photoreceptor by a plurality of charging devices, image exposing means and developing means, each of the plurality of image exposing means comprises an array-shaped plural elements aligned in the axial direction of the photoreceptor and the color image forming apparatus further comprises heating means or heat absorbing means provided for each of the plurality of image exposing means and control means for controlling a temperature of each of the plurality of image exposing means independently of others by the heating means or the heat absorbing means.

21 Claims, 11 Drawing Sheets

COLOR IMAGE FORMING APPARATUS

BACKGROUND OF THE INVENTION

The present invention relates to a color image forming apparatus conducting a color image formation by superimposing plural toner images on a circumferential surface of a photoreceptor drum as an image forming member, in particular, to a digital type color image forming apparatus using an array-shaped image exposing means as an image exposing means in which plural light emitting member composed of an optical system and a light source are arranged in an axial direction of the photoreceptor drum.

Concerning the method for forming a multi-color image, there have been known some methods using the following apparatus: an apparatus (A) in which photoreceptor drums, charging units and developing units each in quantity equivalent to the number of colors necessary for the multi-color image are provided, and toner images each being a mono-color formed on each photoreceptor drum are superimposed on an intermediate transfer drum to form a color image, an apparatus (B) in which one photoreceptor drum is caused to make plural turns so that charging, image exposure and developing for each color are repeated for forming a color image, and an apparatus (C) in which charging, image exposure and developing for each color are conducted in succession while one photoreceptor drum makes one rotation for forming a color image.

However, the apparatus (A) has a drawback that the dimensions of the apparatus are increased because a plurality of photoreceptor drums and intermediate transfer drum are required, while the apparatus (B) has a restriction that the size of a formed image is limited to the surface area or less of the photoreceptor drum although the dimensions of the apparatus can be small because the required number of each of the charging means, image exposure means and photoreceptor is just one set. In this connection, even though the apparatus (C) has a single photoreceptor, the apparatus (C) has not such the restriction in terms of the size of a formed image and an advantage to enable a high speed printing.

However, the apparatus (C) needs to use plural array-shaped image exposing means corresponding to plural different colors. In this case, it is necessary to set a position of an optical system with a high accuracy so that all of the plural allay-shaped image exposing means form an image precisely on the photoreceptor drum, also it is necessary to assure accuracy in registration of image exposure, that is, it is necessary to conform each image forming position of image exposure to be superimposed with others on the image forming surface with an appropriate synchronization. At the same time, in the case that a room temperature in the time of starting image exposure is excessively lower than the usual temperature or in the case that the array-shaped image exposing means is overheated by heat generated by the light source in the time that image exposure is conducted continuously, the optical system of the array-shaped image exposing means shrinks or expands, thereby causing deformation or positional deviation. As a result, image deviation may be caused in toner images to be superimposed. Accordingly, it is necessary to take a counter measure to avoid such the trouble.

More concretely, in a color image forming apparatus shown in FIG. 1 which is one example of the abovementioned apparatus (C), a light emitting member array made in combination of LED arrays and light transmitting members is adopted as one example of the plural array-shaped image exposing means. In the photoreceptor drum is fixed a supporting member on which plural supporting sections are formed. The plural light emitting members are mounted on the supporting sections, whereby an image is formed on the photoreceptor drum from the inside of the photoreceptor drum through the light transmitting member by exposure light emitted from the LED arrays on the supporting section.

Since the LED array constructing the light emitting member arrays generates heat when the LED array emits light in the time of conducting an image formation, in particular, when the LED array emits light continuously, the temperature of the light emitting member becomes extremely high. In the image exposure system in which plural array-shaped image exposing means are provided inside the photoreceptor drum, since heat generated from the plural array-shaped image exposing means is not radiated outside and is accumulated inside, the generated heat may raise a problem. Further, the used situation of the array-shaped image exposing means in the case of a mono-color image formation is different from that in the case of a full color image formation. That is, a black image formation is too many among the mono-color image formation. Accordingly, in order to form a black image (BK), a LED array for black may be used so frequently. In the case of color image formation, in order to form a yellow (Y), magenta (M), cyan (C), and black (BK) image, a plural LED arrays are used. On the other hand, a LED for yellow (Y), magenta (M), or cyan (C) may be solely used depending on an user. Or, an emission rate of each LED may be greatly different from others depending on a specific kind of the color image. In particular, when a mono-color image and a full color image exist in a great number of original document, a temperature difference among the temperature of the plural array-shaped image exposing means is caused by heat generated respectively by them and a thermal expansion of each LED array itself, each light transmitting member and each frame may be different from others, resulting in misregistration among dots formed by the plural array-shaped image exposing means. Further, since temperature rise usually causes light amount drop, it may become impossible to obtain an image with a good color balance due to the light amount difference among the plural array-shaped image exposing means.

The present invention is conceived for the purpose of eliminating the above drawback. That is, even if the above plural array-shaped image exposing means are selectively used and generate heat differently, the misregistration and a fluctuation in light amount may be avoided.

[SUMMARY OF THE INVENTION]

The above objective is attained by the following structures.

(Structure 1)

In a color image forming apparatus in which steps of charging, image exposing and developing are repeated so as to superimposed plural toner images on a photoreceptor drum during a single rotation of a photoreceptor drum so that a multi-color toner image is formed and the multi-color toner image is transferred to a transfer material at a time, the color image forming apparatus is characterized by comprising a heating means for heating an image exposing means conducting the image exposing, a heat absorbing means for absorbing heat from the image exposing means and a control means for controlling a temperature of the image exposing means.

(Structure 2)

In a color image forming apparatus in which steps of charging, image exposing and developing are repeated so as to superimposed plural toner images on a photoreceptor drum during a single rotation of a photoreceptor drum so that a multi-color toner image is formed and the multi-color toner image is transferred to a transfer material at a time, the color image forming apparatus is characterized by providing a heating means for heating an image exposing means conducting the image exposing, or a heat absorbing means for absorbing heat from the image exposing means and a control means for controlling a temperature of the image exposing means for each of the plural image exposing means.

(Structure 3)

In a color image forming apparatus comprising plural charging means, plural array-shaped image exposing means and plural developing means around a photoreceptor drum, when a image formation of a specific color is conducted on the photoreceptor drum by using the developing means, the charging means, the image exposing means and the developing means each associated with the specific color are actuated, and the image exposing means associated with non-use color other than the specific color is compulsively turned on. In Structure 3, when the temperature of the plural image exposing means are within a predetermined temperature or a predetermined temperature difference, the image exposing means associated with the non-use color is not actuated and is not turned on. In Structure 3, the image exposing means associated with the non-use color is turned on in accordance with the extent of the exposing of the image exposing associated with the specific color. In Structure 3, the image exposing means associated with the non-use color conducts the exposing for a non-image formation area. In Structure 3, when the image formation for the specific color is conducted on the photoreceptor drum by the developing means, the charging means, the image exposing means and the developing means each associated with the specific color are actuated, the image exposing means associated with the non-use color other than the specific color is compulsively used, and the developing means associated with the non-use color is not actuated during the image formation for the specific color. In Structure 3, the image exposing means is heated during the stopping of the developing means associated with the non-use color.

(Structure 4)

In a color image forming apparatus comprising plural charging means, plural array-shaped image exposing means and plural developing means around a photoreceptor drum, when a color image formation is conducted on the photoreceptor drum by the developing device, the specified image exposing means is compulsively used. In Structure 4, in a color image forming apparatus comprising plural charging means, plural array-shaped image exposing means and plural developing means around a photoreceptor drum, when the temperature of each image exposing means or the temperature difference among the image exposing means is within a predetermined value, the color image forming apparatus is allowed to be actuated, on the other hand, when the temperature or the temperature difference is not within the predetermined value, the color image forming apparatus is inhibited to be actuated. In Structure 4, when the temperature or the temperature difference is not within the predetermined value, the actuation for a mono-color image formation is allowed. In Structure 4, in order to make the temperature of each image exposing means within a predetermined temperature range or within a predetermined temperature difference range, the specified image exposing means or a part of the specified image exposing means is actuated so as to turn on or is cooled during an image formation or during the stopping of the image formation.

(Structure 5)

In a color image forming apparatus in which plural image exposing means are arranged in parallel on a common supporting member and are provided inside the photoreceptor drum, the color image forming apparatus comprises a heating means provided in the supporting member supporting the plural image exposing means and a temperature control means for controlling the temperature of the heating means. In Structure 5, each of the plural image exposing means is provided with the heating means, and the temperature control means controls the temperature of each heating means. In Structure 5, the temperature control means controls the temperature of the supporting member or temperature difference in the supporting member to be kept within a predetermined value by the heating means. In Structure 5, the temperature control means conducts the temperature control in accordance with the temperature or temperature difference of the plural image exposing means by the heating means. In Structure 5, the temperature control means conducts the temperature control in accordance with an exposure amount of the plural image exposing means by the heating means. In Structure 5, the heating means is divided into plural sections in the axial direction of the supporting member supporting the heating means and each heating section is controlled by the temperature control means.

DETAILED DESCRIPTION OF THE PREFERRED EMBODIMENT

Figure 1:
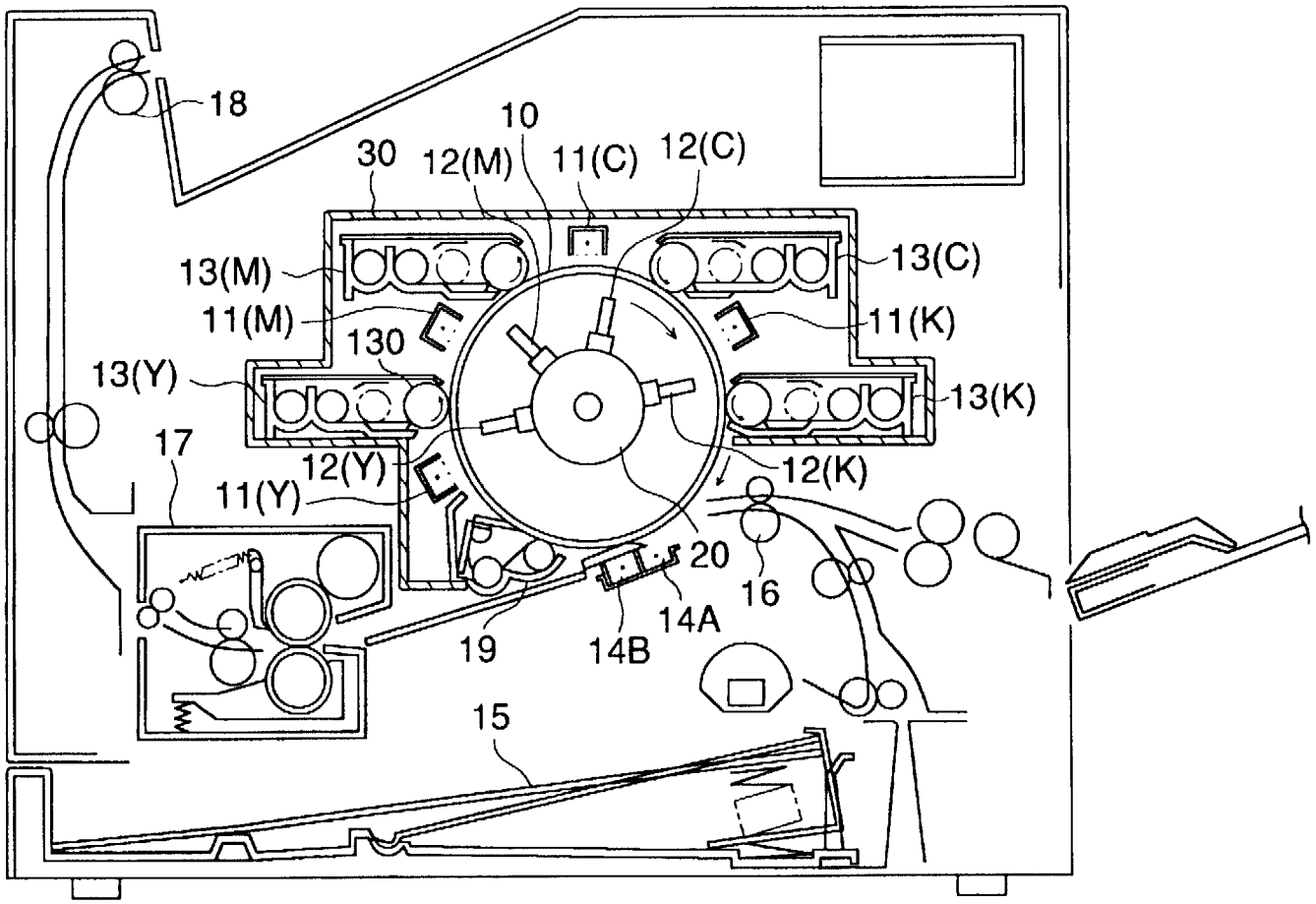
FIG. 1 is a sectional view showing the construction of the color image forming apparatus of the present invention representing an example in which image exposing means are provided inside a photoreceptor drum.
Figure 2:
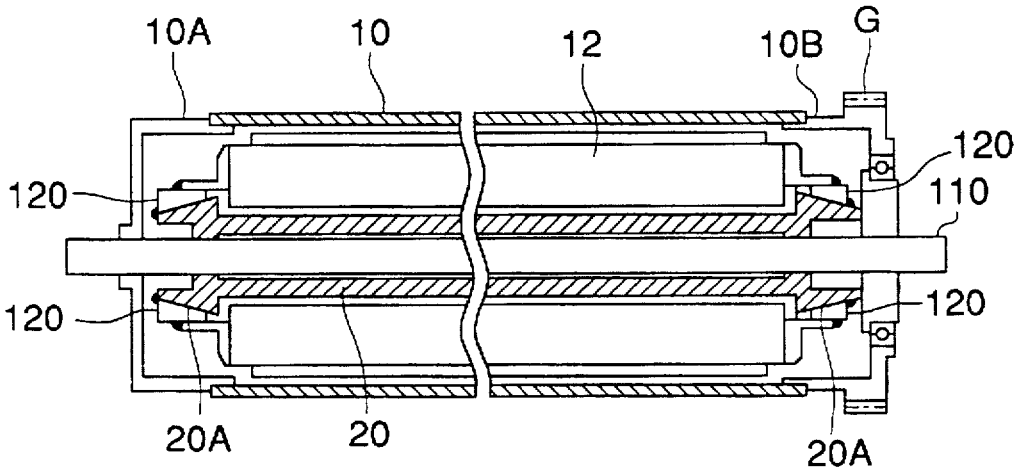
FIG. 2 is a sectional view showing a layout of the image exposing means.
Figure 3:
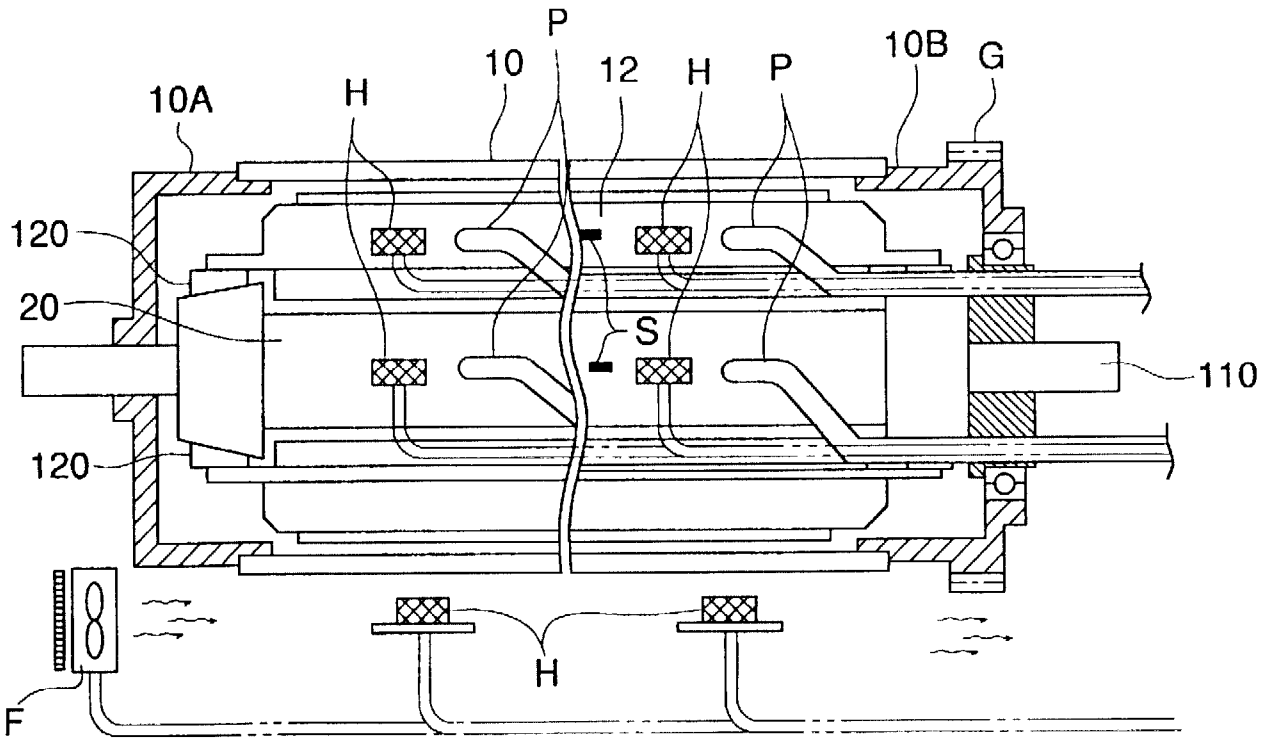
FIG. 3 is a view for explaining an arrangement example of a heating means and a heat absorbing means in the apparatus of FIG. 1.

Embodiments of Structure 1 and Structure 2 of the present invention will be explained with reference to FIGS. 1 through 6.

Numeral 10 is a drum-shaped image-forming member, that is, a photoreceptor drum, and it is composed of a base drum made of optical glass or a transparent member such as transparent acrylic resins whose external circumferential surface is coated with an organic photoconductor layer (OPC) made of a transparent conductive layer. The photoreceptor drum is rotated clockwise on the grounded condition.

Numeral 11 represents a scorotron charging unit used as a charging means, and they charge electrically the aforementioned organic photoconductor layer of the photoreceptor drum 10 with corona discharge by means of a grid retained at a predetermined potential level and a corona wire, thus the outer circumferential surface of the photoreceptor drum 10 is given uniform potential.

Numeral 12 represents an exposure optical system, used as image exposing means, composed of light emitting elements such as LED, FL, EL, PL which are aligned in the axial direction of the photoreceptor drum 10 and Selfoc lenses. Image signals for each color read by a separate image reading device are taken out successively from a memory and are inputted as electric signals into each of the aforesaid exposure optical systems 12. The light emitting elements used in this embodiment has a wavelength in a range of 650 nm to 900 nm.

Each of the aforesaid exposure optical systems 12 is mounted on cylindrical supporting member 20 and is accommodated inside the base drum of the photoreceptor drum 10. Instead of the above light emitting elements, the image exposure means is also composed of an combination of an optical shutter member such as LCS, LISA, and PLZT and an image forming lens such as Selfoc lenses.

The numerals 13Y, 13M, 13C and 13K are developing units containing respectively developing agents of yellow (Y), magenta (M), cyan (C) and K (black), and each developing unit is equipped respectively with a developing sleeve 130 which is spaced from the circumferential surface of the photoreceptor drum 10 so as to keep a predetermined distance and rotates in the same direction as that of the photoreceptor drum 10.

An electrostatic latent image is formed on the photoreceptor drum 10 by the charging conducted by the charging unit 11 and the image exposure conducted by the exposure optical systems 12. The thus formed electrostatic latent image is subjected to reversal development by the developing units 13 (Y, M, C, K). Each developing unit 13 develops the thus formed latent image with a reversal development technique in which a developing bias voltage is applied on a non-contact condition.

Now, an image forming process in the color image forming apparatus of the present invention is explained.

An image read by an image sensor in an image reading device which is separate from the present apparatus, or an image compiled by a computer is stored in a memory momentarily as image signals of each color of Y, M, C and K.

At the start of image recording, the photoreceptor driving motor starts rotating, and photoreceptor drum 10 is thereby rotated clockwise and the scorotron charging unit 11 (Y) starts giving potential to the photoreceptor drum 10 through its charging action simultaneously.

After the photoreceptor drum 10 is given potential, exposure by means of electric signals corresponding to the first color signals, namely yellow (Y) image signals is started from the inside of the photoreceptor drum 10 by the exposure optics system 12 (Y), and an electrostatic latent image corresponding to yellow (Y) image of the document image is formed on a light-sensitive layer on the outer surface of the drum through rotary scanning of the drum.

The latent image mentioned above is subjected to reversal development conducted by developing unit 13 (Y) under the condition that developing agent on a developing sleeve is in the non-contact state, and a yellow (Y) toner image is formed as the photoreceptor drum 10 rotates.

Then, photoreceptor drum 10 is given potential on the yellow (Y) toner image thereon through charging operation of the scorotron charging unit 11 (M), then it is exposed to electric signals of exposure optical system 12 (M) corresponding to the second color signals, namely to magenta (M) image signals, and thereby a magenta (M) toner image is superposed on the aforementioned yellow (Y) toner image through reversal development of a non-contact type conducted by developing unit 13 (M).

In the same process as in the foregoing, a cyan (C) toner image corresponding to the third color signals formed by the scorotron charging unit 11 (C), exposure optical system 12 (C) and developing unit 13 (C) and a black (K) toner image corresponding to the fourth color signals formed by the scorotron charging unit 11 (K), exposure optical system 12 (K) and developing unit 13 (K) are formed and superposed in succession, thus a color toner image is formed on the outer circumferential surface of the photoreceptor drum 10 within its one rotation.

A color toner image thus formed on the outer surface of the photoreceptor drum 10 is transferred onto a transfer sheet by the action of the transfer unit **14*a*, wherein the transfer sheet is sent out from the sheet feed cassette 15 and is fed synchronously with the toner image on the photoreceptor drum 10 by the drive of the timing roller 16**.

Transfer sheet onto which the toner image has been transferred is electrically discharged by the discharger **14*b*, so that the transfer sheet is separated from the peripheral surface of the drum. In the fixing unit 17, toner is fused so that the toner is fixed onto the transfer sheet. Then the transfer sheet is discharged onto the paper discharge tray on the apparatus by the paper discharge rollers 18**.

After the transfer sheet has been separated from the photoreceptor drum 10, the surface of the photoreceptor drum 10 is cleaned by the cleaning device 19 so that the residual toner is removed. In this way, the toner image formation is continued. Alternatively, the toner image formation is once interrupted to wait for formation of a new toner image.

The photoreceptor drum 12 is accommodated in a cartridge 30 together with the charging units 11, the developing units 13 and the cleaning device 19 so as to form one unit and is attached to or detached from the apparatus body in the form of the one unit.

The photoreceptor drum 10 is provided with flange members 10A and 10B on its both ends by which the photoreceptor is rotatably supported on bearings on a drum shaft 110 fixed inside the cartridge 30. When the cartridge 30 is attached to the apparatus body, a gear G formed on the flange 10B is engaged with a driving gear on the apparatus body and the photoreceptor drum 10 is rotated with the gear G.

The drum shaft 110 is made in one body with a supporting member 20 whose both ends are shaped to form a slanted surface 20A. A wedge-shaped bonding member 120 is provided as a adjusting member on the slanted surface 20A and each of the exposure optical systems 12 is fixed on the supporting member with adhesive.

In each of the exposure optical system 12, electric heaters H used as a heating means and heat pipes P used as a heat absorbing means are provided closer to the exposure optical system 12 in plural pieces as necessary at each of required positions arranged lengthwise on a side surface of a LED head in which the light emitting elements (LED) used as a light source are incorporated.

Also, temperature sensors S are provided at each of required positions. In accordance with the detected temperature, when the exposure optical system 12 is in a shrinking condition due to a low ambient temperature at the time of starting image exposure, the exposure optical system 12 is heated by the electric heater H so that the temperature of the exposure optical system 12 is promptly raised to a predetermined temperature corresponding to the ambient temperature n the time of initially setting the positions, whereby the exposure optical system is released from the shrinking condition and becomes a normal condition so that no color deviation is caused. In contrast, in the case that there is a fear that the exposure optical system becomes an expanding condition due to heat generated during a period that LED conducts continuously image exposure, the heating by the electric heat is stopped and heat accumulated in the LED head is radiated outside the apparatus by the circulating action by convection of the heat absorbing material in the heat pipes P, whereby the temperature of each of the exposure optical system is always maintained within the level of the predetermined temperature.

Furthermore, the electric heater H and the heat pipe P are provided to the supporting member 20 used as the supporter for the exposure optical system 12 and to the photoreceptor in which the exposure optical system 12 is incorporated and, also, the temperature sensors S are provided to required positions, whereby the abovementioned temperature control for the exposure optical system is conducted in the similar manner. As a result, the temperature control for the exposure optical system is conducted more efficiently.

For the supporting member 20, the electric heaters H and the heat pipes P are provided in close contact with it in accordance with necessity in plural pieces at each of required positions arranged lengthwise in the same manner as that for the LED head. On the other hand, for the photoreceptor 10, the electric heater H is positioned slightly away from the outer circumferential surface of the drum and a propeller fan F creating air current in the axial direction for the drum surface is used as the heat absorbing means.

Figure 4:
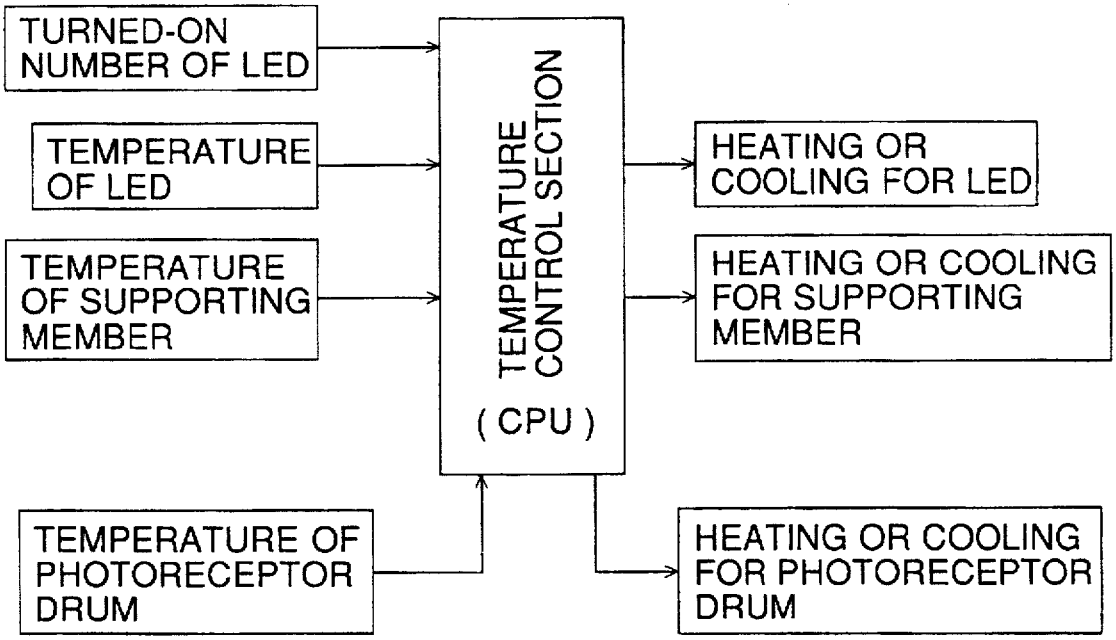
FIG. 4 is a circuit for controlling a temperature of an image exposing means.

The temperature of each of the LED head, the supporting member 20 and the photoreceptor drum 10 is always automatically controlled so as to become a predetermined temperature, for example, 40° C. by a temperature control section in a control circuit shown in FIG. 4 in accordance with the temperature inputted by the temperature sensor. Although the temperature control is conducted during the image exposure, at the initial stage that the power source of the apparatus is turned on, the temperature control is conducted so as to obtain the predetermined temperature during the waiting for the printing, and thereafter, the printing is conducted. As the predetermined temperature, a temperature slightly higher than the room temperature is set.

The temperature control can be conducted without the dependence on the temperature sensor. That is, as soon as the image exposure is started, the number of turned-on times (light emission times) of LED of the exposure optical systems 12 is inputted successively into the CPU of the temperature control section and is summed up. Until the number of turned-on times reaches the predetermined number, the LED head, the supporting member 20, and the photoreceptor drum 10 are heated only by the electric heater H, and the heat pipe P and the propeller fan are not used so that the cooling for each machinery member by heat absorption is not conducted.

On the other hand, when the number of turn-on times exceeds the predetermined number, the heating by the electric heater H is stopped, the heat pipe P and the propeller fan F starts working so that the cooling for each machinery member by heat absorption is started. Whereby the heat generated by the LED itself is balanced so as to maintain the targeted predetermined temperature of 40° C.

As a result, each of the exposure optical systems 12 can always conduct image exposure with the same positional accuracy as that in the time of the initial position setting of the optical system so that the accuracy in positional registration of image exposure can be guaranteed.

In the color image forming apparatus shown in FIG. 1, the exposure optical system 12 is accommodated inside the photoreceptor drum. However, the exposure optical system 12 can be mounted outside the photoreceptor drum as shown in FIG. 5.

Figure 5:
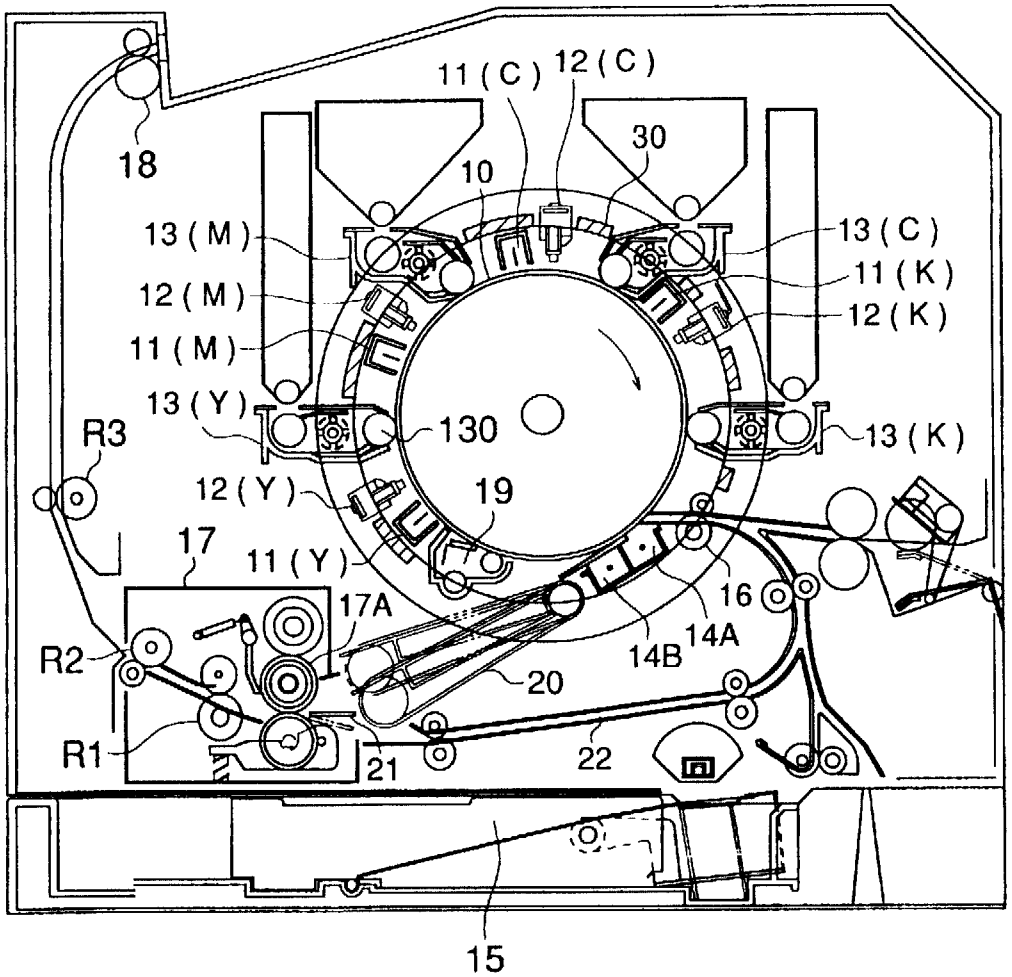
FIG. 5 is a sectional view showing a construction of the color image forming apparatus of the present invention representing an example in which image exposing means are provided outside a photoreceptor drum.

Namely, in the color image forming apparatus shown in FIG. 5, a cylindrical member 40 whose circumferential surface is slit in the axial direction so as to form plural slits is disposed outside the photoreceptor drum 10 as the supporter for the exposure optical systems. Each of the exposure optical systems 12 is supported on a supporting member 40A fitted in the slit of the cylindrical member 40 and glued with a pasting member 120 used for position adjustment onto the supporting member 40A.

Figure 6:
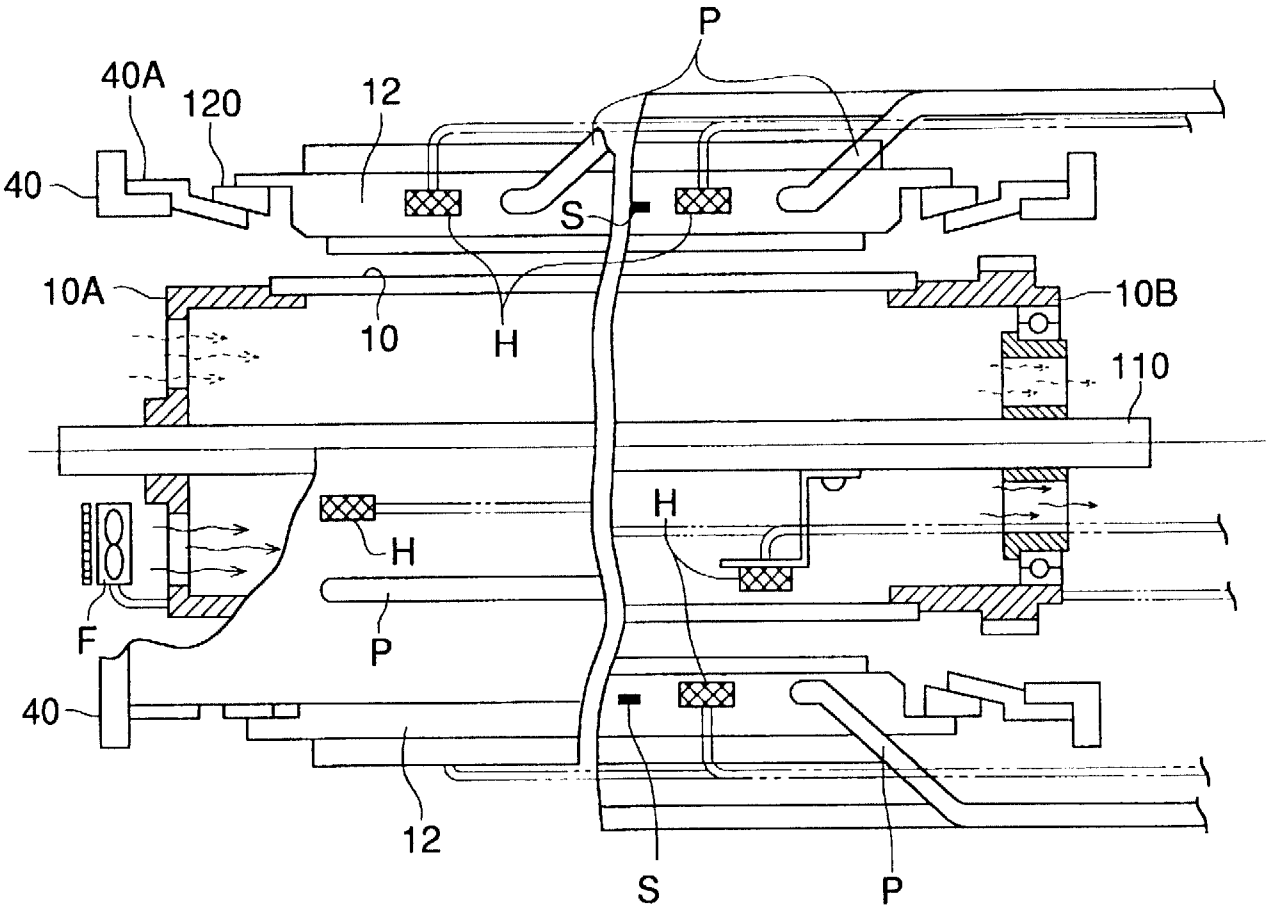
FIG. 6 is a view for explaining an arrangement example of a heating means and a heat absorbing means in the apparatus of FIG. 5.

As shown in FIG. 6, the electric heater H and the heat pipe P are provided in close contact with required positions in accordance with necessity in plural pieces at each of the required positions arranged in the axial direction on the outer circumferential surface of the cylindrical member 40 and on the LED head of each of the exposure optical systems 12.

On the other hand, the electric heater H provided for the photoreceptor 10 is supported by the drum shaft 110 and conducts heating from a position slightly distant from the inner circumferential surface of the drum. A propeller fan F mounted on the front of the flange member 10A feeds air into the inside of the drum through the opening of the flange member 10A and the air is exhausted to the outside through the opening of the flange member 10B, whereby heat radiation is conducted. With this structure, even if the exposure optical system is mounted outside the photoreceptor drum 10, the temperature of each machinery member is controlled to maintain the predetermined temperature by the function of the temperature control section shown in FIG. 4 in the same manner as the example explained with regard to FIG. 1.

Incidentally, in the color image forming apparatus shown in FIG. 5, machinery members having the same function of the machinery members in the color image forming apparatus shown in FIG. 1 are provided with the same reference number as that of the corresponding machinery member in FIG. 1.

With Structure 1 and Structure 2 of the present invention, as soon as the image exposure is started, the temperature of the image exposing means reaches to a predetermined temperature. Further, even if the exposure is conducted continuously, the overheated condition can be avoided. Whereby the image formation is always conducted under the predetermined temperature. In the present invention, since fluctuation in registration accuracy due to shrinkage or expansion of the image exposing means can be avoided, it is possible to provide the color image forming apparatus in which the superimposition of images can be conducted with high accuracy and high quality image having no color deviation and no image bleeding.

Embodiments corresponding to Structures 3 through 5 are explained with reference to FIGS. 7 through 16.

Figure 7:
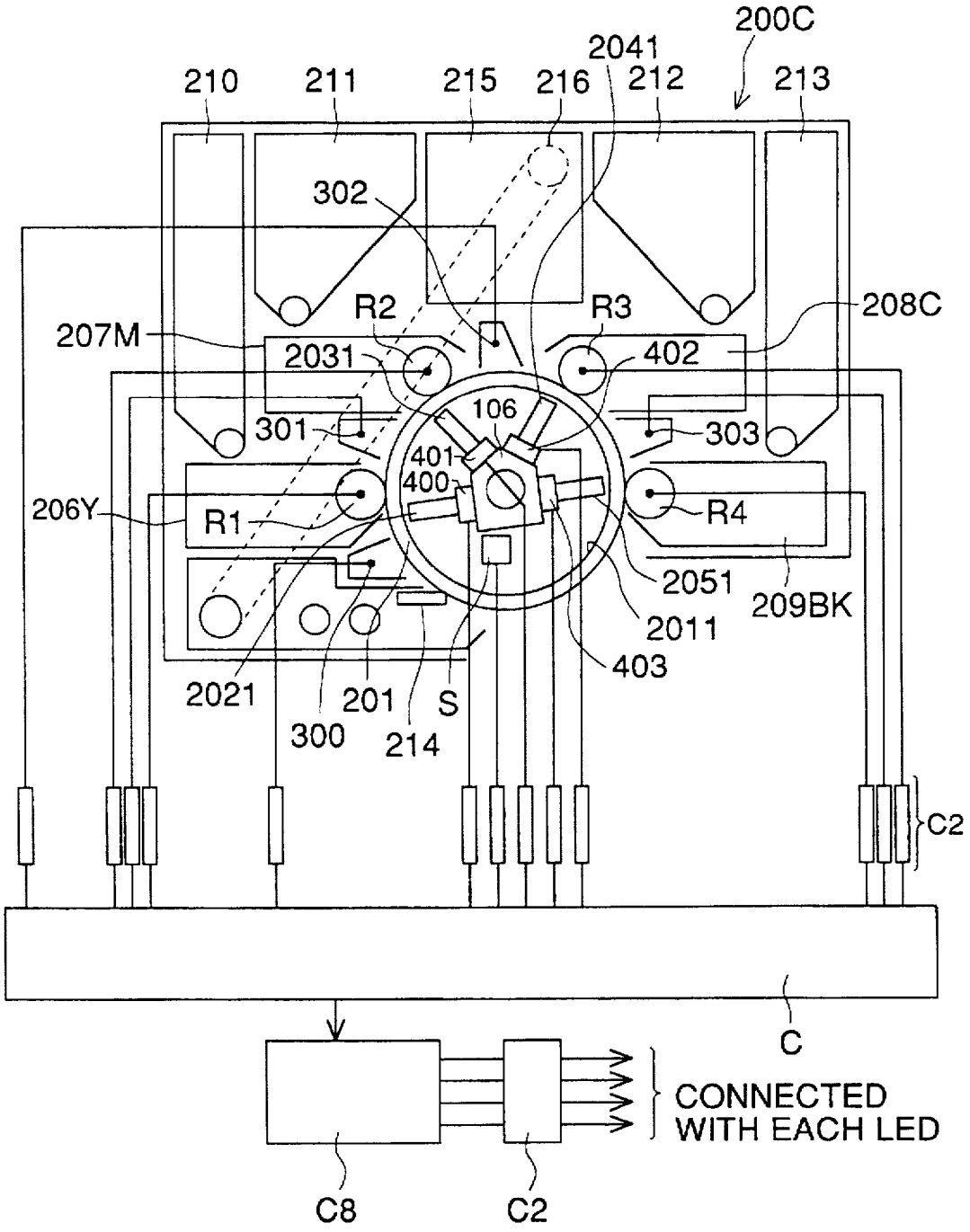
FIG. 7 is a view showing a construction of a process cartridge dismounted from the color image forming apparatus of the present invention in which a control section is indicated.

In the color image forming apparatus shown in FIG. 7, a photoreceptor drum 201 is accommodated in a process unit 200C. A supporting member 106 is provided in the photoreceptor drum 201 and fixed in the process unit 200C. On the supporting member 106 are provided in the radial direction image exposing means 202, 203, 204, 205 in which LED arrays 400, 401, 402, 403 as light emitting elements are integrated in one body with light transmitting member with the aid of frame so that the image exposing means 202, 203, 204, 205 are arranged along the internal surface of the photoreceptor drum 201. The controlling structure of the color image forming apparatus 200 is composed of a control section C for controlling image forming processes, a input-output section C2 including an A/D converting section, a D/A converting section, a driver, a motor, and a power source, and a frame memory C8. Image signals of each color stored in the frame memory C8 are outputted as electric signals from the frame memory C8 through the input-output section C2 corresponding to the driver for the LED in synchronization with a timing control by the control section C, whereby the LED array 400, 401, 402, 403 in the image exposing means 202, 203, 204, 205 are turned on and image exposure is conducted from the inside surface of the photoreceptor drum 201. Reference S is a temperature detecting means of the supporting member 106.

Further, the input-output section C2 is provided to each of the developing devices 206Y, 206M, 206C, 206BK, and includes a motor to rotate a developing roller R1, R2, R3, R4 facing the photoreceptor drum with a predetermined gap and a bias power source to apply a developing bias.

In the case of forming a mono-color image, for example, in the case of forming a yellow image, a charging unit 300, an image exposing means 202, a developing unit 206Y for yellow are used. In this case, since only the LED array corresponding to a specific color of yellow are used in order to a required mono-color image, the temperature is raised in only the LED array for yellow. As a result, thermal expansion or reduction of light amount takes place in only the LED array for yellow. Therefore, when a color image is formed after such the yellow image, positional registration among the LED arrays becomes out of order or light amount balance among the LED arrays fluctuates. In the result, high quality color image may not be formed. In order to avoid such the troubles, the rest of the LED arrays other than the LED array for yellow are heated so as to become the same condition as that of the LED array for yellow, whereby no deviation takes place among the LED arrays and the troubles can be avoided.

Figure 8:
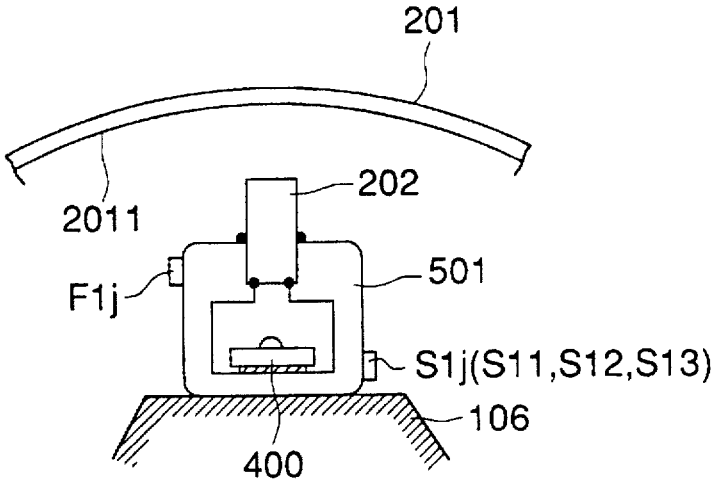
FIG. 8 is a front view showing a temperature detecting means and a exposure optical system in the color image forming apparatus of the present invention.
Figure 9:
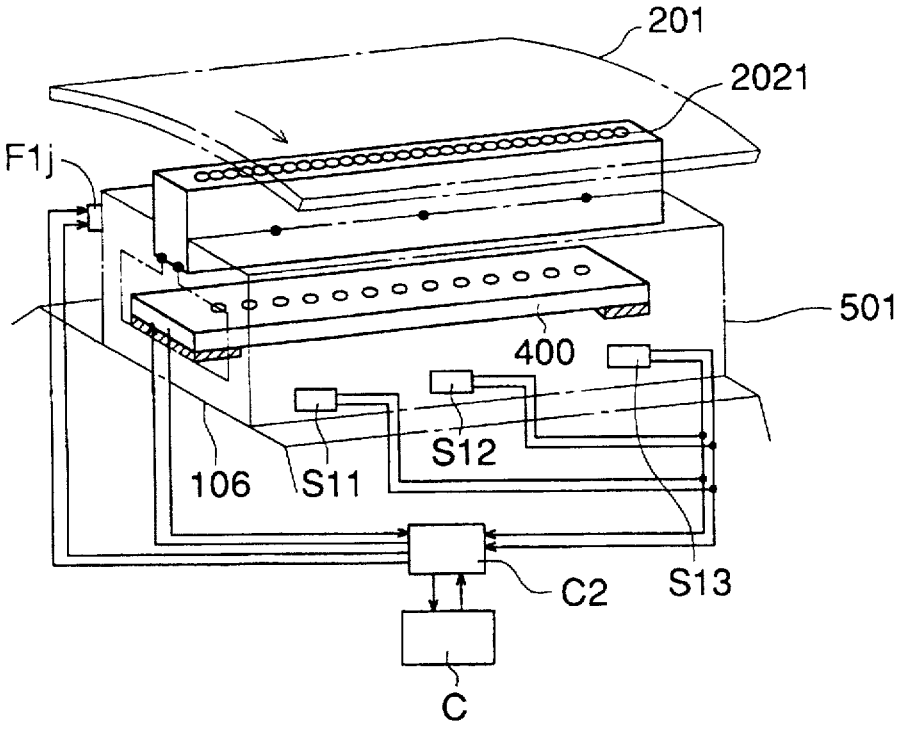
FIG. 9 is a perspective view showing a temperature detecting means and an exposure optical system in the color image forming apparatus of the present invention.

FIGS. 8 and 9 show a structure in which a temperature detecting means Sij is provided. fluctuation in the temperature among the LED arrays caused by different light emission is detected by temperature detecting means S11, S12, S13 (i=1) placed on three different positions shown in FIG. 9 as the temperature detecting means Sij, whereby temperature correction is conducted. Incidentally, reference "i" of the temperature detecting means Sij is a numeral of 1 to 4 and corresponds to a head of LED array 400, 401, 402, 403 used for yellow (Y), magenta (M), cyan (C), black (BK) respectively. Likewise, reference "j" of the temperature detecting means Sij is a number of the temperature detecting means provided in the head of each LED array. In the example shown in FIGS. 8 and 9, since the temperature detecting means are provided on three different positions, j is a numeral of 1 to 3. If the temperature detecting means is provided only a single piece, j is only 1.

As an example, a structure of the image exposing means 202 in which the LED array 400 for yellow image exposure and the light transmitting member are provided on the frame member 501 is explained. The frame member 501 in which the LED array 400 is fixed is made of an aluminum material having a good thermal conductivity and is fixed on the supporting member 106. The light transmitting member 202 is provided on the frame member 501 in such a manner that one end of the light transmitting member faces the LED array and the other end faces the photoreceptor drum 201, whereby the image exposing means 202 is constructed. The plurality of the temperature detecting means S11, S12, S13 are aligned on a part of the frame member 501. Further, Peltier elements Fij used for cooling are provided in the same numbers of the temperature detecting means Sij on a part of the frame member 501 in such a way that the Peltier elements Fij are arranged symmetrically on the opposite side to the temperature detecting means Sij. As shown in FIG. 9, the temperature detecting means S11, S12, S13 detect the temperature respectively and the control section C conducts the temperature control through the input-output section C2 by controlling the heat generating action of the LED array 400 and the cooling action of the Peltier elements Fij in accordance with the detected temperature and the predetermined temperature condition. In this example, since the LED 400 is used for Yellow (Y), the numeral of i of the Peltier elements Fij is 1.

Figure 14:
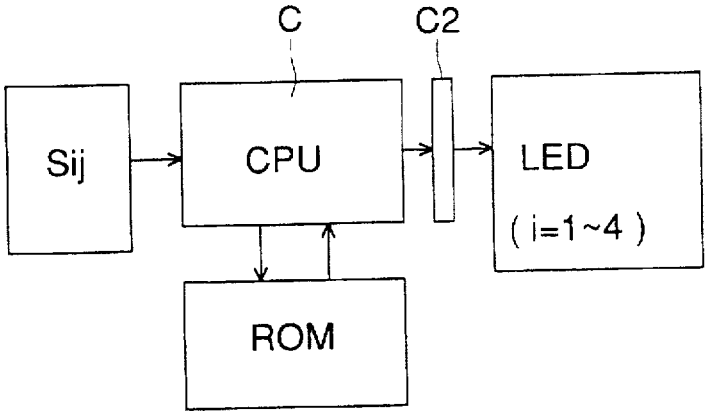
FIG. 14 is a block diagram showing a control for the color image forming apparatus of the present invention.

FIG. 14 shows a block diagram of control sections. The temperature of each of the LED arrays is measured by the plurality of the temperature detecting means Sij and temperature signal Tij are outputted. Herein, reference "i" of Tij corresponds to the number of the plurality of the LED arrays and reference "j" corresponds to the positions in the LED array. Therefore, Tij correspond to the temperature detected by the plurality of the temperature detecting means Sij. The temperature Tij are inputted into the control section C. Then, the control section judges whether the temperature Tij is within a predetermined temperature range stored in a ROM table or whether the temperature difference among the temperature Tij is within a predetermined temperature difference range. In the case that the temperature Tij is out of the predetermined temperature range or the temperature difference is out of the predetermined temperature difference range, the LED array 401, 402, 403 other than the LED array 400 for yellow are forcibly turned on and conduct exposure action for the photoreceptor drum 201 through the LED arrays 2031, 2041, 2051. During this time, the photoreceptor drum 201 can be allow to stop rotating.

If the LED arrays 401, 402, 403 are forcibly turned on while the photoreceptor drum 201 is rotated, no image formation is conducted by stopping the rotation of the developing sleeve and the application of the developing bias for each of the developing devices 207M, 208C, 209BK. Alternatively, in order to avoid any influence on the yellow image on the photoreceptor drum 201, it may be preferable to conduct the forced light emission of the LED arrays 401, 402, 403 on the non-image region of the photoreceptor drum other than the image forming region on which the yellow image is formed. By the forced light emission, the LED arrays 401, 402, 403 are forcibly turned on in accordance with the temperature of each of them or the temperature difference among them, whereby the heat generating condition of them is made equal or close to that of the LED array 400 for yellow. As a result, the thermal expansion and the emitting light amount of each of the LED arrays 400, 401, 402, 403 and the thermal expansion among the light transmitting members are made equal to each other or the difference in them becomes small and the influence on the image formation can be reduced. Further, when the LED arrays 400, 401, 402, 403 becomes overheated, they may be cooled by the Peltier elements Fij in accordance with the temperature of each of them and the temperature difference among them.

As an example, if the temperature of each of the LED arrays 400, 401, 402, 403 is within the predetermined range of 40°±10° C., and the temperature difference among them and the temperature difference among the light transmitting members are within 10° C., the control section C does not conduct the forced light emission for the LED arrays 401, 402, 403. Also, when the required number of print sheets are few and the working hours of the LED array 400 for forming a yellow mono-color image is short, or when the emitting light amount of the LED 400 is small and the temperature Tij measured by the temperature detecting means S is within the permissible range, it is not necessary to conduct the forced light emission for the LED arrays 401, 402, 403. The above explanation was made with reference to an yellow mono-color image as one example. However, in the case of the other mono-color image formation such as magenta (M), cyan (C), black (BK), blue (B), green (G), red (R) by using a corresponding specific LED, the temperature control can be conducted in the same way as mentioned above.

When the specific LED array is used, and then the temperature of the specific LED array is higher than the predetermined temperature or the temperature difference of the specific LED in comparison with the other LED array is lager than the predetermined temperature difference, the forced light emission may be conducted for the other LED arrays which were not used.

Further, when the measured temperature is higher than the predetermined temperature range 40°±10° C. or the temperature difference is lager than the predetermined temperature difference 20° C., a color image formation may be inhibited. On the other hand, during the mono-color image formation, when the temperature of the LED arrays 400, 401, 402, 403 and the temperature of the light transmitting members measured by the temperature detecting means Sij are out of the predetermined temperature range 40°±10° C. or the temperature difference is lager than the predetermined temperature difference 20° C., the problem of the registration is not occurred in the mono-color image formation, differing from the color image formation. Accordingly, the mono-color image formation may be continued without being inhibited.

Figure 15:
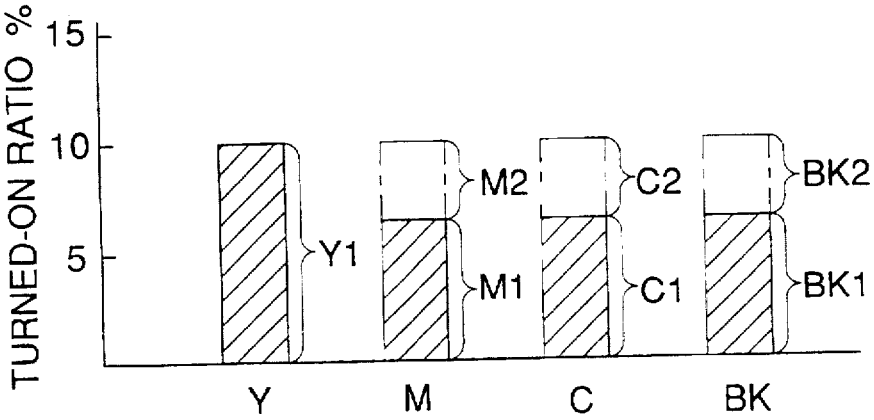
FIG. 15 is an explanatory view showing a heating condition of the exposure optical system in the color image formation of the color image forming apparatus of the present invention.

Next, in the case of forming a color image corresponding to the multi-color image data in which all of the LED arrays 400, 401, 402, 403 are used, all of the LED arrays are not turned on with the same ratio. In FIG. 15, the emitting light amounts (turned-on ratio) of each of the LED arrays 400, 401, 402, 403 corresponding to yellow (Y), magenta (M), cyan (C), black (BK) as component colors of a color image are indicated in the axis of ordinates as one example. The turned-on ratio Y1 of yellow in one image frame is 10%. The turned-on ratio M1 of magenta is smaller in M2 than Y1. Also, the turned-on ratio C1 is smaller in C2 than Y1, and the turned-on ratio BK1 is smaller in BK2 than Y1. As can be seen from this example, when the above full color image is formed, since the emitting light amounts of the LED arrays 401, 402, 403 become shorter than the LED array 400, the temperature differences among them take place, resulting in the change in the length of each LED array by thermal expansion. Also, there is a fear that the light amount differences among the LED arrays take place, resulting in that high quality image may not be formed. However, even under such the circumstances, the temperatures Tij of the LED arrays measured by the temperature detecting members Sij are inputted into the control section C. As result of judgment by the control section in comparison with the predetermined temperature or the predetermined temperature difference stored in a ROM table, when the temperature is out of the predetermined temperature range or when the temperature difference is large than the predetermined temperature difference, the LED arrays 400, 401, 402, 403 may be forcibly turned on in accordance with the temperature of each LED array or the temperature difference of each LED array to the others and conducts the light emitting action through the light transmitting members 2021, 2031, 2041, 2051 onto the photoreceptor drum surface 201.

As described above, the LED arrays 400, 401, 402, 403 are turned on in accordance with the shortage in the emitting light amount, whereby the temperature or the temperature difference can be corrected. When the temperature or the temperature difference exceeds over the predetermined value, resulting in the condition that is not suitable for the color image formation, the control section C may stop the color image formation. The forced light emission may be conducted when the rotation of the photoreceptor drum 201 is stopped.

If the forced light emission is conducted while the photoreceptor drum 210 is rotated, no image formation is conducted by stopping the developing action by stopping the rotation of the developing rollers R1, R2, R3, R4 of the developing devices 206Y, 206M, 206C, 206BK. Alternatively, when the LED arrays 400, 401, 402, 403 are forcibly turned on during the color image formation, the forced light emission is conducted on the no image region of the photoreceptor drum 201 other than the image forming region on which the color image is formed, whereby any influence on the color image formed on the photoreceptor drum 201 may be avoided.

Figure 10:
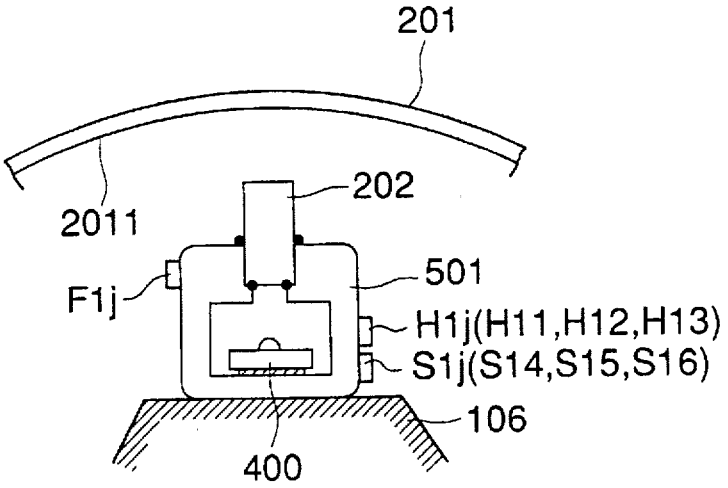
FIG. 10 is a front view showing an exposure optical system, a heating means and a temperature detecting means in the color image forming apparatus of the present invention.
Figure 11:
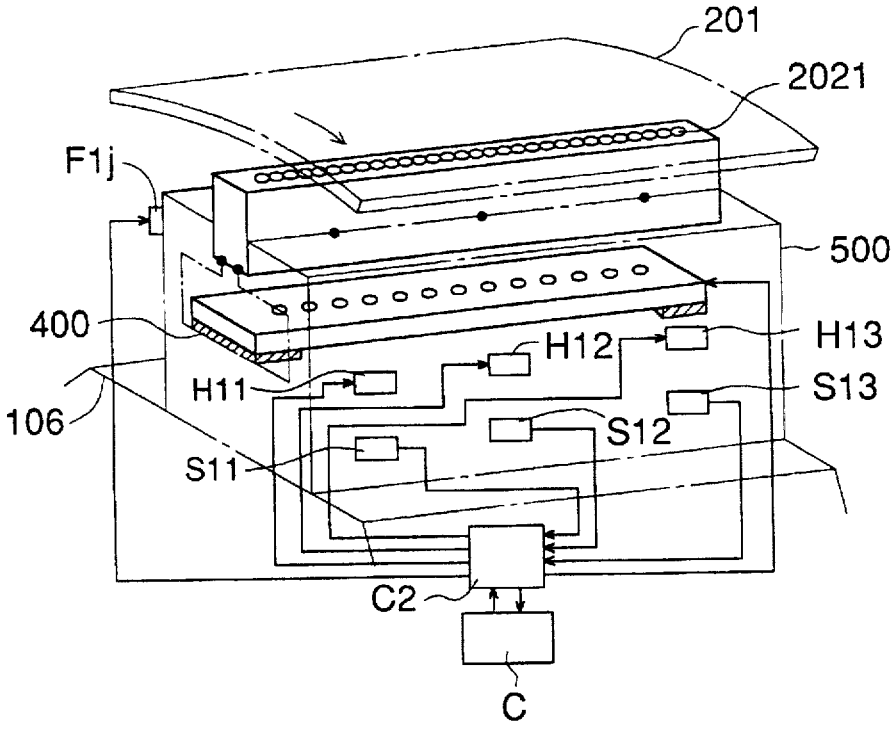
FIG. 11 is a perspective view showing an exposure optical system, a heating means and a temperature detecting means in the color image forming apparatus of the present invention.

FIGS. 10 and 11 show a structure in which the temperature or the temperature difference due to change in light emitting hours in the turned-on time of the LED array is corrected by heating means Hij (or a heater). Herein, reference "i" of the heating means Hij is a numeral of 1 to 4 and corresponds to a head of the LED arrays for yellow (Y), magenta (M), cyan (C), black (BK). On the other hand, reference "j" is a number of the heating means provided in the head of the LED array. In the example shown in FIGS. 10 and 11, the reference "j" is a numeral of 1 to 3.

Figure 16:
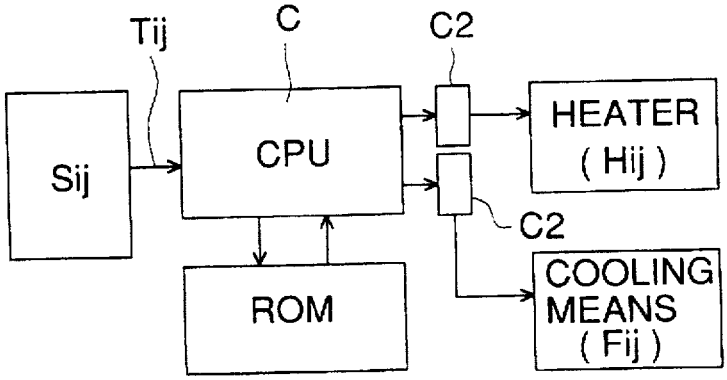
FIG. 16 is a block diagram showing another control for the color image forming apparatus of the present invention.

As one example, a structure is explained with reference to the LED array 400 (i=1) for yellow image exposure. A frame member 501 in which the LED array 400 is fixed is made of an aluminum material having a good thermal conductivity and is fixed on the supporting member 106. Light transmitting members 202 are provided on the frame member 501 in such a manner that one end of the light transmitting member faces the LED array and the other end faces the photoreceptor drum 201. The plurality of heating means H11, H12, H13 in which the reference "i" of the heating means Hij is made 1 are fixed a part of the frame member 501 and also the plurality of the temperature detecting means S11, S12, S13 for detecting the temperature of the heating means H11, H12, H13 are provided on a part of the frame member 501. Further, Peltier elements Fij used for cooling are provided in the same numbers of the temperature detecting means Sij on a part of the frame member 501 in such a way that the Peltier elements Fij are arranged symmetrically on the opposite side to the temperature detecting means Sij in close proximity to the heating means H11, H12, H13 and the light transmitting member 2021. As shown in FIG. 11, the temperature detecting means S11, S12, S13 detect respectively the temperature in the vicinity of the heating means and the detected temperatures Tij are inputted into the control section C through the input-output section C2. As shown in FIG. 16, the detected temperatures Tij are subjected to the judgment by the control section C whether the detected temperatures Tij satisfy the predetermined condition in view of the predetermined temperature and the predetermined temperature difference. In accordance with the judgment result, the control section C conducts the temperature control through the input-output section C2 by controlling the heating means H11, H12, H13, the heat generating action of the LED arrays, and the cooling action of the Peltier elements Fij.

Figure 12:
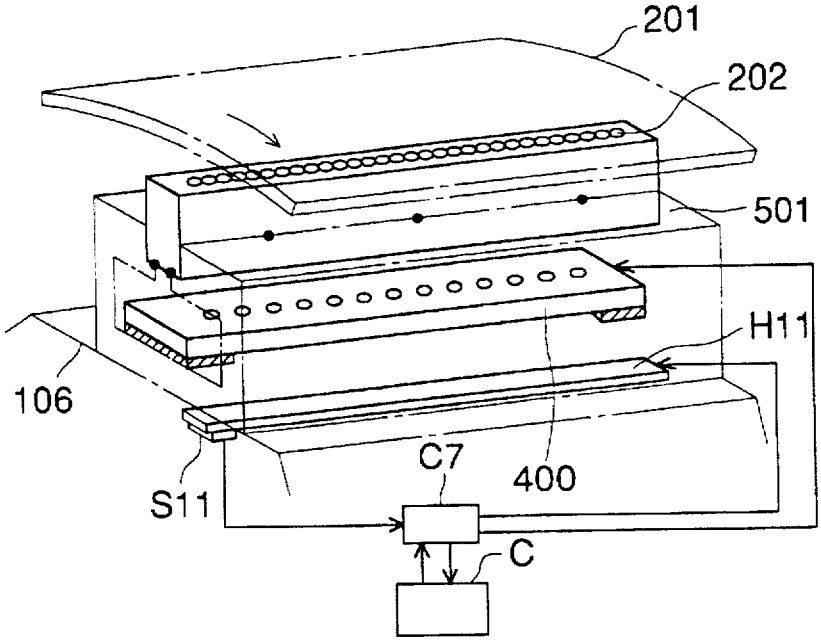
FIG. 12 is a perspective view showing an exposure optical system, another heating means and a temperature detecting means in the color image forming apparatus of the present invention.

FIG. 12 shows an embodiment in which a single wider heating means H11 is provided in the supporting member 106 at a position closer to the LED array. As described above, the structure is explained with reference to the LED array 400 for exposure a yellow image (Y). The frame member 501 in which the LED array 400 is incorporated is fixed on the supporting member 106, and the light transmitting member 2021 is fixed in such a way as shown in the figure that one end of the light transmitting member faces the LED array and the other end faces the photoreceptor drum 201. The heating means H11 is provided at the position beneath the LED array 400 in the supporting member 106 on which the frame member 501 is fixed. As shown in FIG. 12, the heating means H11 is connected with the input-output section C7 which is controlled by the control section C. The temperature detecting means S11 to detect the temperature of the heating means H11 is arranged so as to contact with the heating means H11, in the frame member 501 or the supporting member 106. The temperature of the heating means measure by the temperature detecting means S11 is inputted into the control section C with the temperature "Tij" of the LED array. The control section C conducts the judgment as to the image formation waiting and the image formation inhibition. Further, the control section C judges whether the temperature "Tij" satisfy the condition stored in the ROM table. The LED arrays 400, 401, 402, 403 are forcibly respectively turned on in accordance with the judgment results and conducts the light emitting action onto the surface of the photoreceptor drum 201 through the light transmitting member 202, 203, 204, 205. In this embodiment, since J=1, the heating means 601 is subjected to the temperature control by the control section C through the input-output section C9.

The temperature is controlled in accordance with the below formula so as to avoid the deviation in the registration due to the temperature raise of the LED arrays. In the temperature "Tij", references "i" and "i'" represent the number of the LED array and the reference "j" and "j'" represent the position of the temperature detecting means Sij provided in the supporting means. With regard to the preset temperature To, the control section C controls the temperature difference Δ (Tij–To) so as to satisfy the formula "Δ (Tij–To)≦constant". It may be preferable to set To at 40° C. or near, as one example, within 40° C.±10° C. Alternatively, the temperature difference of Tij may be controlled within the predetermined range. That is, the temperature difference may be controlled so as to satisfy the formula "Δ (Tij–Ti'j') ≦constant". The preferable temperature difference may be within 20° C.

Figure 13:
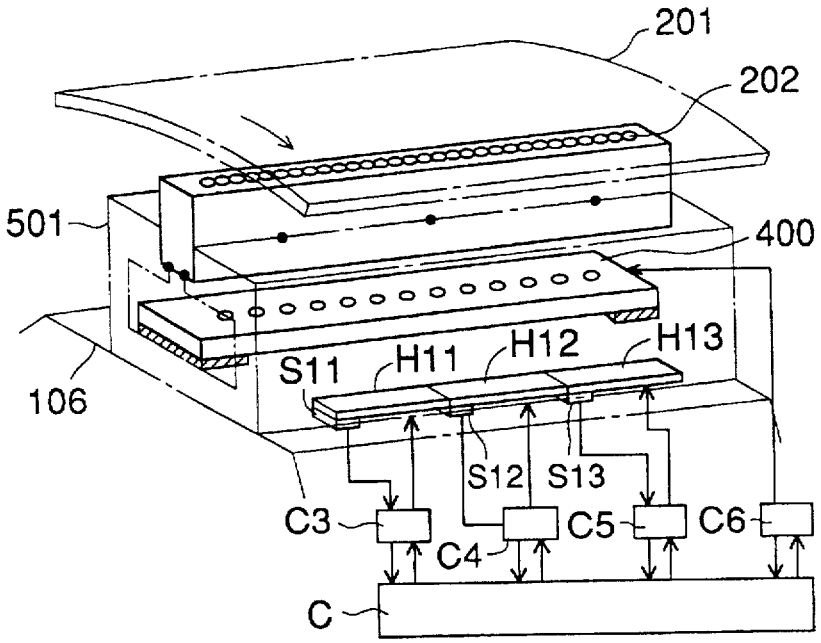
FIG. 13 is a perspective view showing an exposure optical system, another heating means and a temperature detecting means in the color image forming apparatus of the present invention.

FIG. 13 shows another embodiment in which the plurality of heating means are arranged to be parallel or dispersed for the LED array. In this embodiment, the structure is explained with reference to the LED array 400 for exposure a yellow image (Y). The frame member 501 in which the LED array 400 is incorporated is fixed on the supporting member 106, and the light transmitting member 2021 is fixed in such a way as shown in the figure that one end of the light transmitting member faces the LED array and the other end faces the photoreceptor drum 201. The heating means H11, H12, H13 are separated and arranged in parallel along the LED array 400 at the positions beneath the LED array 400 in the supporting member 106 on which the frame member 501 is fixed. As shown in FIG. 13, the heating means H11, H12, H13 are connected with the input-output sections C3, C4, C5. The temperature detecting means S11, S12, S13 to detect the temperature of the heating means H11, H12, H13 are arranged to the plural heating means respectively directly, in the frame member 501 or the supporting member 106. The temperature of the heating means H1, H2, H3 measured by the temperature detecting means S11 are inputted into the control section C through the input-output sections C3, C4, C5 and the temperature of the heating means H1, H2, H3 are controlled by the control section C through the input-output sections C3, C4, C5 depending on the heating condition by the light emission of each elements of the LED array 400.

Further, in the temperature control for the heating means H11, H12, H13, the temperatures "Tij" of the LED array are inputted into the control section C. The control section compares the temperatures Tij with the preset temperature and the preset temperature difference stored in the ROM table. If the temperatures Tij are out of the range of the preset temperature and the preset temperature difference, the LED arrays 401, 402, 403 may be forcibly turned on and conduct the light emitting action for the surface of the photoreceptor drum 201 through the light transmitting members 203, 204, 205. When only specific sections of the LED array 400 are turned on in accordance with the image data, the generating heat amount of each section of the LED array becomes different from the other sections. Accordingly, the heating means H11, H12, H13 conduct the heating for the sections having not emitted light under the control of the control section C through the input-output sections C4, C5, C6 in accordance with the differently generated heat amount due to the different images. Of course, a plurality of heating means for yellow (Y), magenta (M), black (BK) are provided and conduct the heating for the light emitting sections which are short in the generating heat amount. With this heating action by the plurality of the heating means, the thermal expansion of all of the heating means used for the exposing action are made substantially equal to each others and high quality image formation can be conducted.

As described above, the Peltier elements Fij used for cooling are provided in close proximity to the LED array, and the control section C controls the heating action by the heating member Hij and the cooling action by the Peltier elements Fij, whereby the thermal expansion of the LED array may be avoided and high quality image may be formed. Also, the forced light emission of the LED array is not conducted evenly over all of the LED arrays, the LED arrays are separated into several blocks in accordance with the temperature detecting means and the Peltier elements and the forced light emission is conducted partially for each block as necessary, whereby the temperature control can be conducted easily in accordance with the temperature distribution in the head.

As discussed above, the structures 3 through 5 of the present invention is explained with reference to the color image forming apparatus in which the image exposing means is mounted inside the photoreceptor drum as shown in FIG. 7. However, the structures 3 through 5 of the present invention can be applied to the color image forming apparatus as shown in FIG. 5 in which the image exposing means is mounted outside the photoreceptor drum.

In a color image forming apparatus, when a mono-color image of a single image is formed or a color print is mixed in the documents, only a part of the light emitting elements emits light. In particular, when only specific light emitting elements among plural light emitting elements are used so as to emit light for a long term, the other light emitting element are affected by the thermal expansion and the image formed by them is also affected. However, in the present invention, by controlling the heating means and the cooling means, the other light emitting elements are made on the substantially same condition of the light emitting elements used for the image formation, thus the formed image quality is not affected. Consequently, even when a mono-color image is formed or a color image mixed in the document is formed, high quality image can be always formed.

What is claimed is:

1. In a color image forming apparatus comprising a photoreceptor, a charging device to charge the photoreceptor, a plurality of exposing means to expose the photoreceptor so as to form a latent image on the photoreceptor, a plurality of developing means to develop the latent image with toners differing in color so as to form toner images, wherein plural toner images are superimposed on the photoreceptor during a single rotation of the photoreceptor by the charging devices, the image exposing means and the developing means, the color image forming apparatus is characterized in that each of the plurality of image exposing means comprises an array-shaped plural elements aligned in the axial direction of the photoreceptor and the color image forming apparatus further comprises heating means or heat absorbing means provided for each of the plurality of image exposing means and control means for controlling a temperature of each of the plurality of image exposing means independently of others by the heating means or the heat absorbing means, wherein in each of the plurality of array-shaped image exposing means is subjected to a forced light emission used as the heating means independently of others, and wherein a specific color image formation among the plural different colors is conducted, the charging means, the array-shaped image exposing means and the developing means used for the specific color image formation are activated, and the other array-shaped image exposing means other than the array-shaped image exposing means used for the specific color image formation are subjected to the forced light emission.

2. The apparatus of claim 1, wherein the photoreceptor comprises a drum made of a transparent material, the plurality of array-shaped image exposing means and a supporting member for supporting the plurality of array-shaped image exposing means are provided in the photoreceptor drum, and wherein the image exposing is conducted from the inside of the photoreceptor drum and the toner images are formed on the outer surface of the photoreceptor drum.

3. The apparatus of claim 2, wherein the heating means is provided on the supporting member and a temperature or a temperature difference of the supporting member is controlled to be kept within a predetermined range.

4. The apparatus of claim 1, wherein the photoreceptor is provided inside a supporting member by which the plurality of array-shaped image exposing means are mounted along the outer circumferential surface of the photoreceptor.

5. The apparatus of claim 4, wherein the supporting member is a cylinder.

6. The apparatus of claim 1, wherein each of the plurality of array-shaped image exposing means is provided with a temperature detecting means.

7. The apparatus of claim 1, wherein each of the plurality of array-shaped image exposing means is divided into plural sections and each of the plural sections is provided with the heating means or the heat absorbing means so that the temperature of each section is controlled independently of others.

8. The apparatus of claim 1, wherein the heat absorbing means is a heat pipe.

9. The apparatus of claim 1, wherein the heat absorbing means is Peltier cooling elements.

10. The apparatus of claim 1, wherein a specific array-shaped image exposing means among the plurality of array-shaped image exposing means or a part of the specific array-shaped image exposing means is subjected to the forced light emission or is cooled during the specific color image formation or during non image formation so as to control the temperature or the temperature difference of each of the plurality of array-shaped image exposing means to be within the predetermined range.

11. The apparatus of claim 1, wherein when the temperature or the temperature difference of each of the plurality of array-shaped image exposing means is within the predetermined range, the other array-shaped image exposing means is not subjected to the forced light emission.

12. The apparatus of claim 1, wherein the other array-shaped image exposing means conduct light emission in accordance with the extent of exposure by the specific array-shaped image exposing means.

13. The apparatus of claim 1, wherein when the temperature or the temperature difference of each of the plurality of array-shaped image exposing means is within the predetermined range, the color image forming apparatus is allowed to be operated, in contrast, when the temperature or the temperature difference of each of the plurality of array-shaped image exposing means is not within the predetermined range, the color image forming apparatus is inhibited to be operated.

14. The apparatus of claim 1, wherein when the temperature or the temperature difference of each of the plurality of array-shaped image exposing means is not within the predetermined range, the color image forming apparatus is allowed to be operated to form a mono-color image.

15. The apparatus of claim 1, wherein the other array-shaped image exposing means conduct the forced light emission for non-image forming region.

16. The apparatus of claim 1, wherein the other array-shaped image exposing means conduct the forced light emission while the developing means corresponding to the other array-shaped image exposing means are stopped.

17. The apparatus of claim 1, wherein the control means conducts the temperature control for the heating means in accordance with the exposure amount of the plurality of array-shaped image exposing means.

18. A color image forming apparatus, comprising:

a photoreceptor;

a charging device to charge the photoreceptor;

a plurality of image exposing means to expose the photoreceptor so as to form a latent image on the photoreceptor;

a plurality of developing means to develop the latent image with toners differing in color so as to form toner images;

a control device to control the charging device, the plurality of image exposing means and the plurality of developing means so as to superimpose the toner images on the photoreceptor during a single rotation of the photoreceptor;

each of the plurality of image exposing means comprising array-shaped plural exposing elements aligned in an axial direction of the photoreceptor, and a base member on which the array-shaped plural exposing elements are mounted as one unit;

a supporting member on which the base member of each of the plurality of image exposing means is fixed, wherein the base member is made of a thermal conductive material so that heat generated by each of the plurality of image exposing means is discharged through the base member to the supporting member;

each of the plurality of image exposing means further comprising at least one of heating means and heat absorbing means, and a sensor for outputting a signal representing a temperature of the array-shaped plural elements; and a control device for receiving the signal from the sensor and controlling said at least one of heating means and heat absorbing means, whereby a temperature of each of the plurality of image exposing means is controlled independently of others.

19. The apparatus of claim 18, wherein the photoreceptor comprises a drum made of a transparent material, the plurality of array-shaped image exposing means and a supporting member for supporting the plurality of array-shaped image exposing means are provided in the photoreceptor drum, and wherein the image exposing is conducted from the inside of the photoreceptor drum and the toner images are formed on the outer surface of the photoreceptor drum.

20. The apparatus of claim 18, wherein the temperature or a temperature difference of each of the plurality of image exposing means is controlled to be kept within a predetermined range.

21. The apparatus of claim 18, wherein the photoreceptor is shaped as a drum and the supporting member is shaped as a cylinder and is mounted coaxially around the photoreceptor.

* * * * *